United States Patent [19]

Jimenez et al.

[11] Patent Number: 5,063,865

[45] Date of Patent: Nov. 12, 1991

[54] ZIG-ZAG SEWING MACHINE WITH AN OSCILLATING CRADLE FOR SLIDINGLY MOUNTING A NEEDLE BAR

[75] Inventors: Antonio Jimenez, Meyrin; Michel Combepine, Les Avanchets, both of Switzerland

[73] Assignee: Mefina S.A., Switzerland

[21] Appl. No.: 443,359

[22] Filed: Nov. 30, 1989

[30] Foreign Application Priority Data

Nov. 30, 1988 [CH] Switzerland ..... 4439/88

[51] Int. Cl.[5] ..... D05B 3/02

[52] U.S. Cl. ..... 112/221; 112/443; 112/459

[58] Field of Search ..... 112/221, 443, 455, 459

[56] References Cited

U.S. PATENT DOCUMENTS 2,253,110 8/1941 Cornell .
2,862,468 12/1958 Johnson .
2,989,016 6/1961 Johnson ..... 112/221 X
3,782,311 1/1974 Adams et al. ..... 112/459 X

FOREIGN PATENT DOCUMENTS 881686 5/1943 France .

*Primary Examiner*—Werner H. Schroeder
*Assistant Examiner*—Paul C. Lewis
*Attorney, Agent, or Firm*—Cushman, Darby & Cushman

[57] ABSTRACT

In a sewing machine, an oscillating cradle has two bearings in which a needle bar is slidingly mounted. An external surface of each bearing has a spherical profile by which it is pivotingly engaged in a respective seat of complementary shape provided in a first arm of the cradle, for an upper bearing, and in a second arm, for a lower bearing. A resilient leaf spring, in the form of a U, exerts an axial pressure on both the upper bearing and the lower bearing, to maintain them in their seats in alignment with one another.

6 Claims, 3 Drawing Sheets

FIG. 3
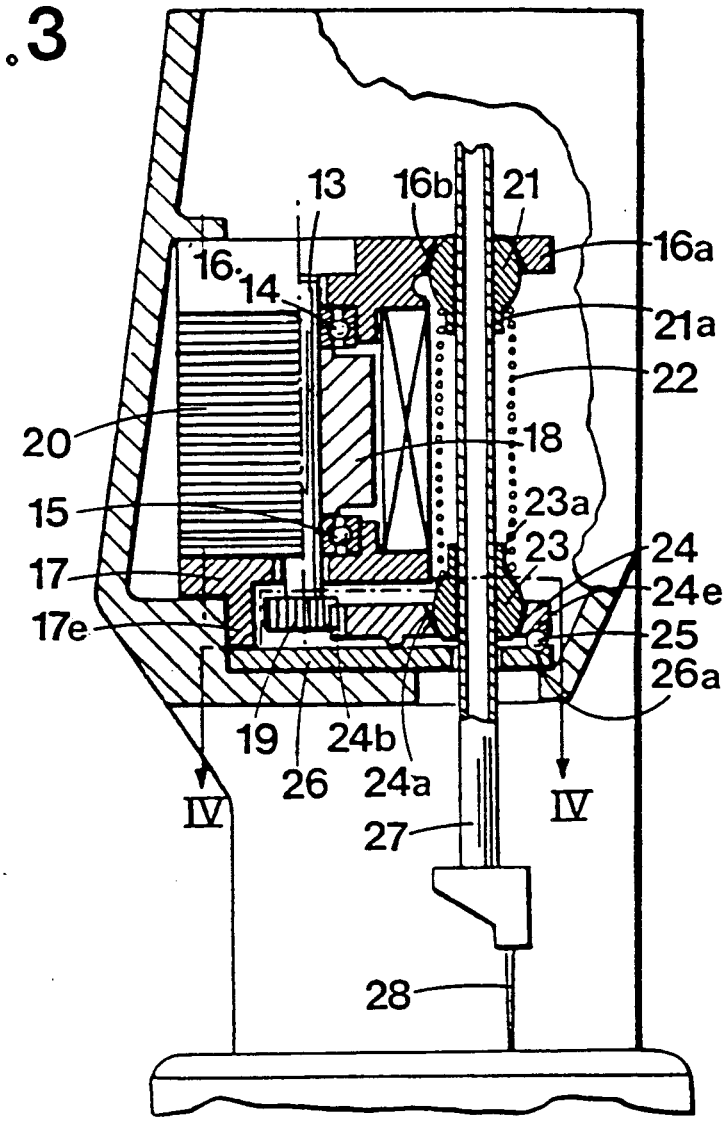
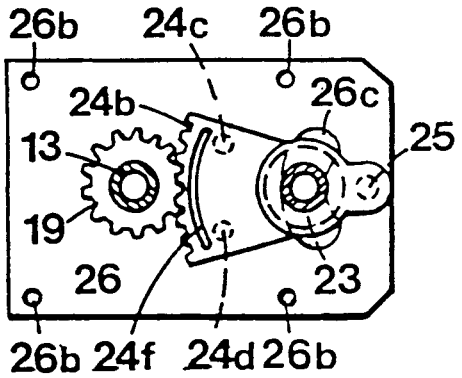
FIG. 4

ZIG-ZAG SEWING MACHINE WITH AN OSCILLATING CRADLE FOR SLIDINGLY MOUNTING A NEEDLE BAR

BACKGROUND OF THE INVENTION

Description of the Prior Art

As is known, the majority of zig-zag sewing machines have comprised, for very many years, a cradle having, generally, the form of a support pivoted about a substantially vertical axis, the support being caused by a mechanism to tilt laterally with an alternating movement and comprising two supports, for example two superpositioned arms, with which there are associated two coaxial bearings adapted to receive a needle bar mounted for axially sliding displacement within the bearings.

Whether it is a question of bearings formed by the walls themselves of axial openings machined directly in the body of the arms, or, on the contrary, of sockets driven into such openings, easy and precise axial sliding of the needle bar depends essentially on one condition: the machining of the openings must be such that on its completion, the openings in question must occupy a rigorously aligned position.

It will be understood that the observance of such a condition may be the source of innumerable problems as much in regard to the machining itself as in respect of the mounting of the assembly: machine builders have therefore been compelled to require to develop particularly elaborate and thus costly machining and finishing processes for the parts.

BRIEF SUMMARY OF THE INVENTION

The present invention provides a zig-zag sewing machine and various modes of assembling its components, which overcomes the disadvantages mentioned above.

According to the invention, there is provided a zig-zag sewing machine, comprising a needle bar slidingly mounted in at least two bearings mounted on respectively a first and a second support which face each other, at least one of said supports being displaceable transversely to the longitudinal axis of the needle bar, means for driving said displaceable support in a to and fro alternating movement of predetermined amplitude so as to impose on the needle bar a corresponding stitching movement, wherein each bearing is formed by a body traversed by a rectilinear passage of transverse cross-section corresponding to that of the portion of the needle bar required to slide within it and having on its external surface at least one contact surface of a shape corresponding to that of the side surface of an annular segment of a sphere centered on a point on the longitudinal axis of said passage, each support having on a surface thereof facing the other support at least one seat for one of said bodies, said at least one seat having a profile corresponding at least in part to that of the contact surface of the body and communicating with an aperture opening on a face of the support opposite to that having the seat and allowing the passage of the needle bar, and each of said bearings being maintained in position with its contact surface against the respective seat by at least one resilient member exerting on each bearing a thrust directed towards its seat.

BRIEF DESCRIPTION OF THE DRAWINGS

The accompanying drawings show, by way of example, two embodiments and a variant of the subject of the present invention:

FIG. 3 is an elevation view, part cut away, of the second embodiment;

FIG. 4 is a view on the line IV—IV of FIG. 3;

DETAILED DESCRIPTION OF THE DRAWINGS

Figure 1:
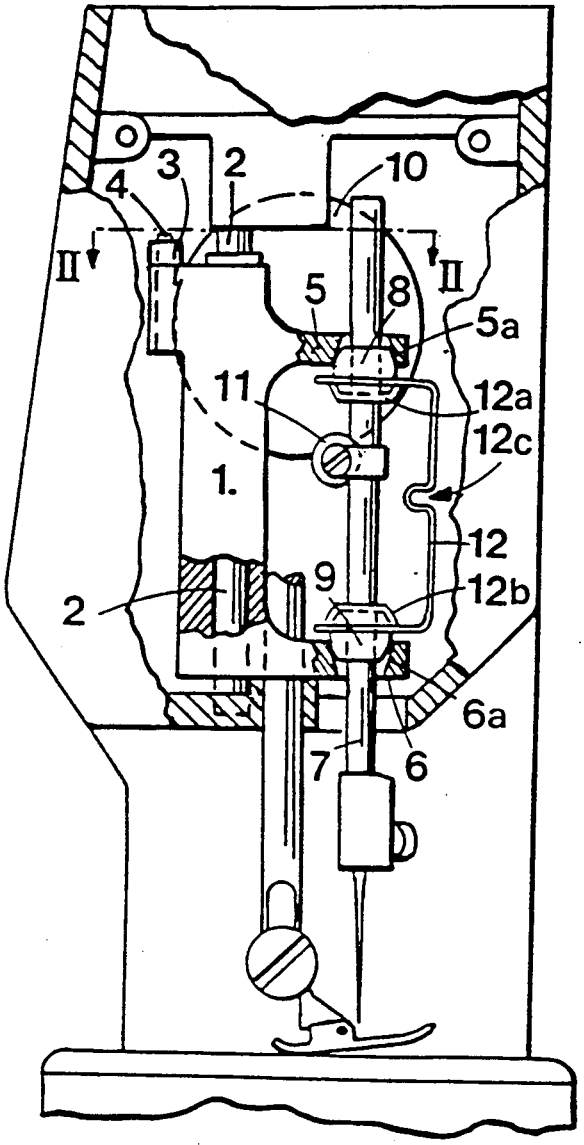
FIG. 1 is an elevation view, part cut away, of the first embodiment.

In the drawing (FIGS. 1 and 2), there may be recognised the cradle 1 of a zig-zag sewing machine, which is pivoted on a vertical shaft 2 and is driven in an oscillating movement by means of a rod 3, partially shown, pivoted on the cradle by a pin 4, the other end of which is subjected to a drive device, not shown, driving this rod alternately in two opposite directions $F_1$ and $F_2$. The amplitude of the axial displacements of the rod 3 may be determined by any known means, for example by cams in the case of mechanically-driven sewing machines, or by computerised instructions in the case of an electronic sewing machine controlled by micro-processor.

The cradle 1 has, in traditional manner, two superpositioned arms 5 and 6, forming a support for a needle bar 7 which is slidingly mounted in bearings 8 and 9 carried by the support 5 and by the support 6, respectively.

Axial drive of the needle bar 7 is effected, in traditional manner, by means of a rotary plate 10 driven by a motor, not shown, a connecting rod, also not shown, carrying a bearing 11 for mounting the needle bar being connected to the plate 10.

As may be seen in the drawing, the bearings 8 and 9 each essentially consist of a partially spherical body, preferably of a material of low coefficient of friction, for example Teflon, Delrin (Trade Marks), or sintered metals, traversed by an axial bore in which the needle bar is able to slide freely.

The bearings 8 and 9 are each engaged in a seat formed by the frustoconical sidewalls of openings **5*a* and 6*a* provided in the arms 5 and 6**, respectively, of the cradle.

Thus the contact between the spherical surface of each bearing 8 or 9 and the seat formed by the sidewalls of the openings **5*a* and 6*a*** takes place in practice between a particularly narrow annular segment of this surface and a corresponding angular segment of the frustoconical sidewall of the respective opening. The width of these annular segments will be directly dependent on the individual elasticity of the material of the body of the bearings and on the force being exerted on this body in the direction of the corresponding seat.

In fact, according to an essential characteristic of the present invention, the two bearings 8 and 9 of the machine shown are maintained in place by the thrust exerted on each of them by a resilient leaf spring 12 having the general form of a U, the free ends of which have eyelets **12*a* and 12*b* by which the leaf spring makes respective contact with the bodies of the bearings 8 and 9. This spring also has a fold 12*c*** in its intermediate part, a fold directed to improving the resilient characteristics of the spring.

The adaptation which has just been described has numerous advantages, as much in regard to manufacture of the parts which form it, as in respect of their assembly and the quality of the assembly.

It is thus that the machining operations for the seats 5*a* and 6*a* do not require the use of very elaborate and costly machines and gauges, to the extent that it is no longer essential to guarantee a very high level of surface quality or the observance of a positioning of great precision relative to the seats.

In fact, by virtue of the adaptation described, the bearings 5 and 6 are centered automatically on assembly as soon as the needle bar has been introduced into them, the whole assembly taking up its correct position with respect to the cradle when the bodies of the bearings are engaged in the respective seat of the supports 5 and 6 of the cradle and the leaf spring exerts its thrust on the two bodies.

Advantageously, the assembly of the adaptation described may be very simply carried out, without any particular tools, by use of one of the four methods hereinafter, for example:

The two bearing bodies are placed on the ends of the leaf spring 12, as illustrated in the drawing, while maintaining these parts assembled by any suitable means; the ends of the spring are then urged towards one another to enable the body of each bearing to be engaged in the respective seats; the parts are released and the needle bar is then engaged through the opening of one of the seats, in a first bearing, then between the supports of the cradle, and finally in the second bearing.

One may also start by placing each bearing in the respective seat, then taking a resilient spring, the ends of the two arms of which are flexed and engage the shells 12*a* and 12*b* of the bodies of the bearings 8 and 9 respectively. One then proceeds as before by passing the needle bar first of all into the bore of one of the bearings, and then, after having crossed the space between the arms 5 and 6 of the cradle into the bore of the second bearing.

One may also start by introducing one end of the needle bar into the space between the supports 5 and 6, while making it pass through one of the openings 5*a* or 6*a* in these supports; a first bearing is then placed onto the bar, the leaf spring 12 and the second bearing; the spring is compressed sufficiently to enable the two bearings to be engaged in the respective seats of the supports 5 and 6 and the needle bar is slid into the bearings and through the second opening 5*a* or 6*a*.

If the ends of the spring are forked, that is to say if the portion of each of these ends which must co-operate with the spherical body of each bearing comprises two blades between which the needle bar may be passed, one may proceed with the mounting of the assembly described by commencing with introduction of one end of the needle bar into the space between the supports 5 and 6 of the cradle, while making this bar pass through one of the openings 5*a* or 6*a*, and then placing onto the bar the first and the second bearing in succession, in reversed position from bearing to bearing. The end of this bar is then engaged through the other opening and the bearings are placed on their respective seats, and the resilient spring is engaged between the bearings in a prestressed position with its two ends engaged against the one and the other bearing, the blades provided at each end of the spring taking up position on each side of the needle bar.

In the embodiment which has just been described, the sewing machine according to the invention may just as well be a mechanically-driven machine as an electronically-controlled machine controlled by microprocessor, for example.

The machine illustrated in FIGS. 3 and 4 is intended essentially to be controlled by electronic means, in particular by electrical pulses generated from computerised instructions.

In such a context, a great number of constructions are indeed known in which the stitching movements of the cradle of the machine are controlled by a stepper motor supplied with a pulsed voltage.

The machines illustrated in FIGS. 3 and 4 incorporate precisely this type of construction.

The drawing shows in particular a stepper motor comprising a shaft 13 mounted on two ball bearings 14 and 15, between two end plates 16 and 17, and carrying the armature 18 of the motor as well as, at its lower end, a pinion 19. The field structure 20 is shown, to the left of the shaft 13, by its stack of stator laminations, and, to the right, by one of its windings.

The end plate 16 extends to the right, beyond the stator 20, to form a lug 16*a* having an opening 16*b* of frustoconical section, narrowing progressively towards the top of the drawing and forming a seat for the spherical external surface of a bearing 21 maintained in this opening by a vertical spring 22 engaged, at its upper end, on a neck 21*a* projecting out on the lower part of the bearing 21 and engaged, at its lower end, on a neck 23*a* of the upper part of a second bearing 23, identical to the bearing 21 and engaged against a seat formed by an opening 24*a*, of frustoconical section, provided in a horizontal lever 24. This section narrows progressively towards the bottom of the drawing.

The lever 24 is shown in the general form of a sector of a circle, toothed at 24*b*, in engagement with the pinion 19 and resting on the upper surface of a complementary support plate 26, on the one hand, by means of two hemispherical projections 24*c* and 24*d*, and on the other hand, by a ball 25, engaged in both a hemispherical recess 24*c* of the lever and in a hemispherical recess of the plate 26. A slot 24*f*, extending in proximity to the teeth 24*b*, ensures resilient contact, damped and without play, between the pinion 19 and the teeth themselves (FIGS. 3 and 4).

The support plate 26 is fixed to a flange 17*e* of the end plate 17, of which only a part is visible in the drawing but which also extends the length of the longitudinal edges of this plate, as far as its right-hand end. This mounting of the support plate is achieved by screws, not shown, passing through the apertures 26*b* and engaging in corresponding threaded holes provided in the flange.

In a variant, not shown, the support plate 26 and the end plate 17 may very well be formed by members of one and the same piece.

An opening 26*c*, of arcuate form, allows vertical passage and lateral movement of a needle bar 27 slidingly mounted in the bearings 21 and 23.

In effect, the ball 25 forms an axis of pivoting for the lever 24, which may thus be pivoted in the clockwise and anti-clockwise directions by corresponding angular displacement of the armature 18 of the stepper motor, each time in a direction contrary to that of pivoting of the lever 24.

Accordingly, it is thus possible to drive the needle bar in a pendular movement about the upper point of pivoting defined by the bearing 21 and to thus obtain stitching action of the needle 28 carried by the needle bar 27. Of course, the pendular movement in question will be of an amplitude programmed by sending to the stepper motor voltage pulses of a number and a polarity dependent on the type of stitches to be sewn.

Figure 6:
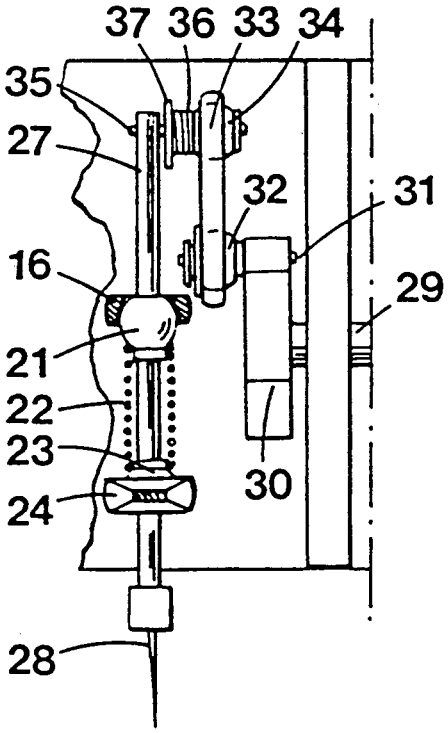
FIG. 6 illustrates the means for axially driving the needle bar in the embodiments of FIGS. 3 to 5.

In regard to the axial drive of the needle bar 27 by sliding in the bearings 21 and 23, this is controlled by the mechanism illustrated schematically in FIG. 6 in which 29 represents a shaft driven at its right-hand end by a motor not shown. A plate 30 is fixed to this shaft. A pivot pin 31 for a bearing 32 is fixed to plate 30 at an eccentric position. The external surface of bearing 32 is of spherical profile and is mounted in a seat of complementary shape, provided at the lower end, in the drawing, of a short connecting rod 33.

At its upper end, this short connecting rod has a seat, of spherical profile, in which a bearing 34 is mounted, the external surface of which has a profile complementary to that of this seat and which is pivotingly mounted on a pin 35.

A spring 36 is compressed between a plate 37, fixed to the pin 35, and a bearing 34, this spring being adapted to compensate for any play which may possibly exist between this bearing and the pin 35. This pin is secured to the upper end of the needle bar 27, to which it transmits the axial movement to which the pin is subjected during rotation of the plate 30.

Furthermore, by virtue of the force exerted by the spring 22 on the bearing 23 and transmitted by this to the lever 24, this lever is assured of being permanently maintained in correct position on the support plate 26 by engagement of the projections **24*c* and 24*d* on this support plate, on the one hand, and by simultaneous engagement of the ball 25 in the recess 26*a* of the support plate and in the recess 24*e* of the lever 24**, on the other hand, without needing the intervention of other retaining members.

Thus, and as may be seen in the drawing, the assembly described is formed of a reduced number of parts, capable of being mounted in particular in any of the manners previously described with reference to the embodiment of FIGS. 1 and 2. One could, for example, commence by mounting the complementary support plate 26 on the flange **17*e* of the end plate 17 of the stepper motor, then place the lever 24 on the end plate 26 while putting its teeth 25*b* in contact with the pinion 19, which is affixed to the shaft of the motor, all of this while inserting the ball 25 into the space delimited by the recess 24*e* of the lever and the recess 26*a* of the support plate 26**.

Two bearings, such as those indicated by the references 21 and 23, are then mounted at the two ends of a spring, such as the spring 22, by engaging the necks **21*a*, 23*a*** respectively of the bearings into the first end opening of the spring and into the second end opening of the spring, respectively.

The entire assembly is compressed axially until its length becomes slightly less than the distance separating the lower surface of the elongation **16*a* of the end plate 16 of the motor and the upper surface of the lever 24, in such a manner as to enable this assembly to be passed between these members (end plate 16 and lever 24), and the bearings 21 and 23 are brought towards the seats 16*b* and 24*a*** provided respectively in this end plate and in this lever.

The spring 22 is allowed to relax so that the bearings engage in the seats hereinabove.

Finally, the needle bar 27 is introduced in the opening of the first bearing (21 or 23), then through the spring 22, and, finally, into the opening of the second bearing, by axial sliding of the bar in the bearings.

By this operation, an absolutely correct self-centering of the bearings 21 and 23 in their respective seats is obtained and thus perfect positioning of the needle bar with respect to the other parts of the assembly described, which is thus ready to be mounted in the body of the sewing machine.

Figure 2:
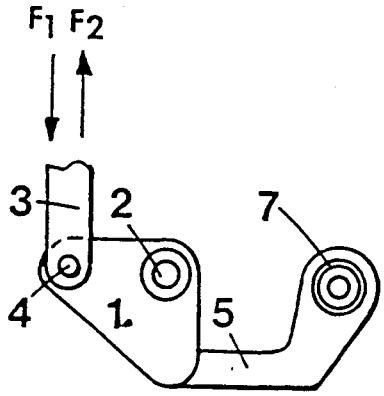
FIG. 2 is a detailed view on the line II—II of FIG. 1.

In a variant, not shown, the spring 22 of the embodiment of FIG. 3 may very well be replaced by a prestressed resilient leaf of the type used in the embodiment of FIGS. 1 and 2 and having, for example, the form of a V, the ends of its arms being engaged against the bearings 21 and 23 respectively.

Figure 5:
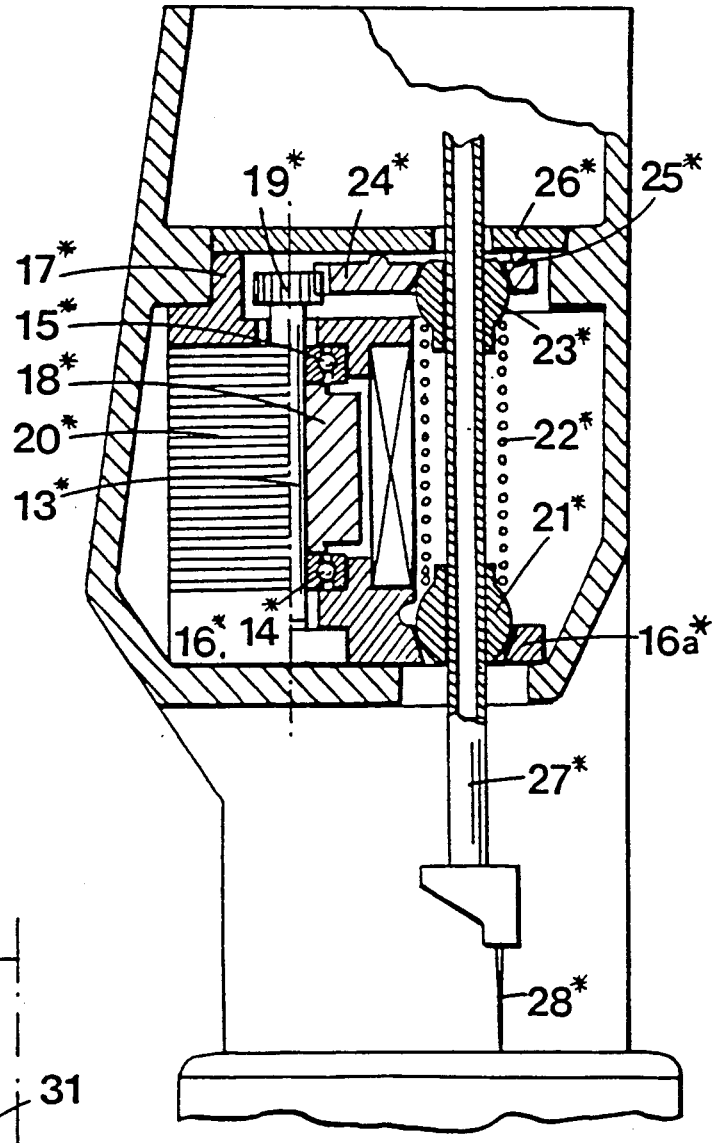
FIG. 5 is a view similar to that of FIG. 3, of the variant.

The structure of the variant of FIG. 5 is different from the embodiment described with reference to FIGS. 3 and 4 only in that it is the upper bearing which is transversely displaceable while the lower bearing remains stationary.

The functional members used in this variant remain however identical to those described with reference to FIGS. 3 and 4: they are therefore identified, in the drawing, by references corresponding to those appearing in these Figures but with the addition of a * character.

Accordingly, the constructional characteristics, the advantages which may therefore result, as well as the modes of assembly which are individual to this variant of FIG. 5 correspond, "mutatis mutandis", to the characteristics, advantages and modes of assembly previously cited with reference to FIGS. 3 and 4.

We claim:

1. A zig-zag sewing machine, including a needle bar mounted to slide in a first and second bearing associated with a first and second support, respectively, means driving the first support in a plane extending transversely to said needle bar in alternating reciprocating motion of predetermined amplitude in such a manner as to impose upon said needle bar a corresponding jogging motion, each said bearing being formed from a body having a rectilinear passage for guiding said needle bar in a sliding motion, at least a portion of a lateral surface of said bearing having a shape corresponding to that of an annular segment of a sphere, said first and second supports having a first and a second opening, respectively, said first and second openings being in alignment and offering passage to said needle bar, at least one annular section of an inner side of said first and second openings, respectively, having a profile corresponding to that of said lateral surface portion of said body of said first bearing, for said first support, and to that of said lateral surface portion of said body of said second bearing, for said second support, a side section of said first opening and a side section of said second opening facing one another and respectively comprising a first and second positioning seat for a portion of said spherical body of said first bearing, and said second bearing respectively, at least one elastic device being placed in a buttressing arrangement between said bearings, resting against the bodies of both bearings, respectively, and tensioned sufficiently to hold each bearing on the seat of its respective support.

2. A machine according to claim 1, wherein the elastic device is a spring prestressed between the bearings.

3. A machine according to claim 2, wherein the spring is a spiral spring surrounding a portion of the needle bar between the bearings.

4. A machine according to claim 2, wherein the spring is formed by a resilient leaf disposed between the bearings in a prestressed position, its ends engaged against both bearings respectively.

5. The sewing machine of claim 3, wherein the bodies of said first and second bearings include a collar having an outside diameter equal to the inside diameter of the spring and forming a portion of said rectilinear passage, said spring having a first and a second end resting on the collar of the first and of the second bearing, respectively.

6. A method of mounting a needle bar of a sewing machine on two supports which are integral with a frame of the machine, wherein the needle bar slides in a first and second bearing, each bearing including a body having a rectilinear passage forming a bush for the needle bar, and an outer face including a bearing surface in contact with a corresponding seat integral with the first of said supports, for the first bearing, and with the second of said supports for the second bearing, respectively, the seat of each support facing that of the other support, each bearing being held in position, in contact with the seat of the respective support, via an elastic device buttressed on said bearings, the first and second bearing resting on said seat of a respective said support via a respective bearing surface, said elastic device being placed under tension in buttressing fashion on both bearings; said first and second bearing being successively traversed by the needle bar, by introducing said bar first into the passage of the body of the first bearing and then causing it to slide in the passage, then engaging the passage of the body of the other bearing and causing it to slide therein, until it is in a desired axial position, the needle bar and bearings thereof being self-centered with respect to said first and second supports.

* * * * *